US006456198B1

(12) United States Patent
Kato et al.

(10) Patent No.: US 6,456,198 B1
(45) Date of Patent: Sep. 24, 2002

(54) FENCE SENSOR

(75) Inventors: Ryochi Kato; Hideto Kato; Kunihide Kamiyama; Kiichi Seino, all of Tokyo (JP)

(73) Assignee: KS Techno Co., Ltd., Tokyo (JP)

( * ) Notice: Subject to any disclaimer, the term of this patent is extended or adjusted under 35 U.S.C. 154(b) by 0 days.

(21) Appl. No.: 09/720,681

(22) PCT Filed: Jun. 23, 1999

(86) PCT No.: PCT/JP99/03330

§ 371 (c)(1),
(2), (4) Date: Mar. 27, 2001

(87) PCT Pub. No.: WO99/67755

PCT Pub. Date: Dec. 29, 1999

(30) Foreign Application Priority Data

Jun. 23, 1998 (JP) ..... 10-191006

(51) Int. Cl.[7] ..... G08B 13/26

(52) U.S. Cl. ..... 340/564; 340/561; 340/660; 340/635; 340/654; 340/664; 340/541; 340/550; 256/10; 256/48; 324/71.1; 324/658

(58) Field of Search ..... 340/564, 561, 340/660, 635, 654, 664, 541, 550; 256/10, 48; 324/71.1, 658

(56) References Cited

U.S. PATENT DOCUMENTS 4,174,518 A * 11/1979 Mongeon ..... 340/561
4,220,949 A * 9/1980 Pope et al. ..... 340/533
4,860,996 A * 8/1989 Robbins, III ..... 256/10
5,877,949 A * 3/1999 Wolfgram et al. ..... 363/61
6,265,981 B1 * 7/2001 Carson et al. ..... 340/660

FOREIGN PATENT DOCUMENTS

JP 55-97688 A 7/1980
JP 57-175286 A 11/1982
JP 58-195789 A 12/1983
JP 59-117696 A 7/1984

* cited by examiner

*Primary Examiner*—Jeffery Hofsass
*Assistant Examiner*—Tai T. Nguyen
(74) *Attorney, Agent, or Firm*—Brinks Hofer Gilson & Lione

(57) ABSTRACT

It is an object of this invention to provide a fence sensor which can achieve an excellent detection stability without using a current for generating an electric field nor infrared rays. The fence sensor comprises a detection electrode (8); a reference electrode (9) insulated from the detection electrode (8); a chargeable member (4) insulated from both of the detection electrode (8) and the reference electrode (9); and a detection circuit (20) for detecting a change in the electrostatic capacitance between the detection electrode and the reference electrode that is generated by the presence of an object to be detected within a detection region of the detection electrode. In this fence sensor, the chargeable member is arranged such that at least a part of the chargeable member is situated within the detection region of the detection electrode. Further, the chargeable member is formed from a conductor.

19 Claims, 8 Drawing Sheets

FENCE SENSOR

FIELD OF THE INVENTION

The present invention relates to a fence sensor, and more particularly to a crime prevention sensor for a fence which can detect the presence of an object that approaches or makes contact with the fence.

BACKGROUND OF THE INVENTION

Among the conventional crime prevention sensors for a fence for detecting an intruder, there has been known an electric field formation type sensor as disclosed in Japanese Patent Laid-Open Publication No. 9-237389. This is a type in which an electric field is generated by supplying sinusoidal current to electric wires embedded in the fence, and an alarm device is actuated when a change of the electrostatic capacity is detected that occurs due to an intrude approaching the fence.

In addition, there has also been known a crime prevention sensor in which an emitting part of infrared rays and a receiving part for receiving the emitted infrared rays are installed in the vicinity of the fence in order to establish an infrared ray detection region along the fence. In this sensor, when an interception of infrared rays by an intruder is detected, an alarm device is actuated.

The electric field formation type sensor uses a sinusoidal wave to generate an electric field, so it has a problem that it becomes a source of noise in telephone lines or electronic circuits found in the vicinity of the fence. Accordingly, installation sites for the sensor are limited.

Moreover, the electric field formation type sensor has a detection region defined by the region where electric wires are laid within the fence, so that it has a problem that it gives restrictions on the fence design.

Besides, the electric field formation type sensor has another problem that the power consumption increases due to the necessity that the electric field has to be maintained all the time.

Furthermore, with respect to the infrared sensor, the detection region between the light emitting part and the light receiving part needs to be formed in a linear shape, so that it has a problem that a detection region cannot be formed along a fence having a curved surface structure.

It is an object of the present invention to provide a fence sensor with an excellent detection stability that resolves the problems associated with the electric field formation type sensor and the infrared sensor described above without requiring electric current for generating an electric field or infrared rays.

SUMMARY OF THE INVENTION

A fence sensor defined by claim 1 comprises:

a detection electrode;

a reference electrode insulated from the detection electrode;

a chargeable member insulated from both of the detection electrode and the reference electrode, the chargeable member being arranged such that at least a part of the chargeable member is situated within a detection region of the detection electrode, and the chargeable member being formed from a conductor; and a detection circuit for detecting a change in the electrostatic capacitance between the detection electrode and the reference electrode that is generated by the presence of an object to be detected within the detection region.

In this structure, when the electrical charges on the chargeable member are increased by the presence of the object within the detection region of the chargeable member, the electrostatic capacitance between the detection electrode and the reference electrode is changed. According to the present invention described above, the fence sensor can detect the presence of the object within the detection region by detecting such a change in the electrostatic capacitance between the detection electrode and the reference electrode. Accordingly, the fence sensor of this invention does not require the formation of an electric field or the use of infrared rays.

For example, if an intruder approaches the detection region, electrostatic induction is generated in the conductive chargeable member due to the charge on the body of the intruder, thus increasing the amount of the charge on the chargeable member. Since the chargeable member is insulated from both of the detection electrode and the reference electrode, the charges on the chargeable member will not move directly to these electrodes as currents. However, since the chargeable member is found within the detection region of the detection electrode, the increase in the charges on the chargeable member forms an electric field in the detection region of the detection electrode, and causes an increase in the charge on the detection electrode. Consequently, the electrostatic capacitance between the detection electrode and the reference electrode is increased. When the increase in the electrostatic capacitance exceeds a detection threshold of the detection circuit, the detection circuit outputs a detection signal.

Further, the use of the chargeable member makes it possible to form a detection region with wider area. For example, when a wide area of the sidewall of the fence is formed as a detection region, the increase in the detection region can simply be achieved by the installation of a chargeable member on the entire sidewall of the fence. However, if the detection electrode and the reference electrode are installed over a wide area, the electrostatic capacitance between the detection electrode and the reference electrode becomes extremely large in the case of absence (static state) of an object in the detection region of the detection electrode.

When the electrostatic capacitance between the detection electrode and the reference electrode is extremely large as in the above, the increased amount of the charge on the detection electrode in the charged state (that is, in a state that an object is found within the detection region) will be relatively extremely small compared with the amount of the charge in the static state. Because of this, the detection circuit has to detect an extremely large increase, relatively speaking, in the amount of the charge, thus impairing detection stability or causing inability of detection. For these reasons, the fence sensor of this invention utilizes the chargeable member. According to such a fence sensor, it is possible to stably detect an object within a wide detection region. Further, it is also possible to achieve the detection without being accompanied by an increase in the electrostatic capacitance between the detection electrode and the reference electrode in the static state.

Here, there is no limitation on a fence in which the fence sensor of this invention is to be installed. Examples of such a fence includes a wall formed of concrete or stone; a palisade formed from support pillars arranged with a prescribed distance apart and a metallic net spread between the support pillars; and the like. Further, such a fence may be installed indoors, and may also be installed outdoors. In addition, the fence sensor of this invention may be installed in a fence so that the detection region covers the entirety of the fence. Further, the fence sensor may also be installed so that the detection region covers a part of the fence (e.g., handrails of the fence).

Further, the use of the fence sensor is not limited to the purpose of crime prevention. For example, a fence sensor of this invention may be installed on a fence in the rear of a parking lot in order to give a warning about the approach of a vehicle to the fence. According to such a fence sensor, it is possible to prevent collision of a vehicle with the fence.

The fence sensor defined by claim 2 further comprises water film separation means for separating a water film on the surface of the chargeable member from a water film grounded to the earth.

A fence sensor defined by claim 3 comprises:

a detection electrode;

a reference electrode insulated from the detection electrode;

a chargeable member arranged such that at least a part of the chargeable member is situated within a detection region of the detection electrode, the chargeable member being formed from an insulator; and a detection circuit for detecting a change in the electrostatic capacitance between the detection electrode and the reference electrode that is generated by the presence of an object to be detected within the detection region.

When an intruder approaches the chargeable member (which is an insulator), induced polarization is generated in the chargeable member due to the charges on the body of the intruder. Then, an electric field is generated in the detection region of the detection electrode by polarized charges generated by the induced polarization. As a result of the formation of the electric field, the electrostatic capacitance between the detection electrode and the reference electrode is increased, and the detection circuit detects the presence of the intruder.

Here, there is no limitation on material used for making the insulator, and shape of the insulator. For example, the insulator may be prepared using material such as wood, a synthetic resin, stone, earthenware, concrete, and the like.

In the fence sensor defined by claim 4, the detection electrode and the reference electrode are partially or completely concealed by the chargeable member.

Since the fence sensor of this invention has the detection electrode and the reference electrode which are concealed by the chargeable member, it tends to be difficult to make approach to or direct contact with both the electrodes. Because of this, according to the present invention, it is possible to prevent breakdown of the detection circuit by electrostatic sparks. This arrangement is made for avoiding the following undesirable case. That is, when the air is dry, the charge quantity on the body of the intruder is extremely large. In such a condition, if both the detection electrode and the reference electrode are exposed, electrostatic sparks are generated between the electrodes and the human body, and its high voltage current will instantly destroy the detection circuit that is connected to these electrodes.

Further, according to the fence sensor of this invention, the chargeable member is insulated from both the detection electrode and the reference electrode. Consequently, it is possible to make the chargeable member absorb the high voltage current by the electrostatic sparks, thus making it possible to prevent a high voltage current from directly flowing to the detection circuit. In addition, the fence sensor of this invention has an advantage that an easy revealing of the presence of the sensor can be avoided because of the concealment of the electrodes by the chargeable member.

In this invention, the detection electrode and the reference electrode are partially concealed. This means to conceal only a portion that has a high possibility of making approach to or contact with the human body, that is, to conceal only a portion where electrostatic sparks tend to be generated between the electrodes and the human body. In addition, it means to conceal only portions that make these electrodes readily identifiable from the outside.

In the fence sensor defined by claim 5, the reference electrode is connected electrically to the ground or a building.

When the reference electrode is connected to the ground, it is possible to set the detection threshold higher, since the electrostatic capacitance between the detection electrode and the reference electrode in the charged state can be increased compared with the case where it is not connected to the ground. Therefore, the ratio of the signal to noise generated by the environment (i.e., S/N ratio) can be enhanced, and the detection stability can be improved.

Here, the connection with the ground means to connect the reference electrode to the ground in the case where the fence is installed on the ground. Further, the connection with the building also means to connect the reference electrode to the building in the case where the fence is installed in the terrace or the like of the building. In this connection, the electrical connection will not involve the use of a grounding resistance as a necessary condition.

In the fence sensor defined by claim 6, the chargeable member is provided with water repellent means.

For example, in the case where the chargeable member is made of concrete which is an insulator, if moisture infiltrates into the chargeable member, the migration of charges within the chargeable member is facilitated by the hydrogen ions that are charged positively, and thus the chargeable member is converted to a state that resembles to that of a conductor.

Accordingly, the rate of increase of the electrostatic capacitance of the detection electrode in the static state and the electrostatic capacitance in the charged state decrease relatively. Because of this, the detection circuit has to detect the increase rate that is relatively decreased, and it becomes necessary to enhance the detection precision.

For this reason, in this invention the water repellent means is provided in the chargeable member in order to prevent infiltration of moisture into the interior of the chargeable member. This makes it possible to keep the charge quantity on the chargeable member in the static state, and thus a high detection precision is maintained.

The fence sensor defined by claim 7 further comprises directivity control means for limiting the direction of the electric lines of force of the detection electrode.

According to the fence sensor having such directivity control means, for example, it is possible for the fence sensor to detect an intruder who tries to jump over the fence, and also possible to avoid detecting a pedestrian who passes along the fence.

In the fence sensor defined by claim 8, the directivity control means is a shielded electrode connected to the reference electrode. This fence sensor has the shielded electrode connected to the reference electrode, so that it is possible to completely shield off unwanted electric lines of force of the detection electrode.

The fence sensor defined by claim 9 further comprises at least one inter-electrode chargeable member which is disposed between the detection electrode and the reference electrode, and which is insulated from both of the detection electrode and the reference electrode. This fence sensor is capable of stabilizing the sensitivity of the detection electrode, and reduce the detection threshold of the detection circuit by equipping it with the inter-electrode chargeable members. Accordingly, the detectable region of the sensor can be extended.

In the fence sensor defined by claim 10, the detection electrode includes first and second detection electrodes which are insulated from each other, and the detection circuit includes comparison means for comparing electrostatic capacitance between the first detection electrode and the reference electrode with electrostatic capacitance between the second detection electrode and the reference electrode.

In the fence sensor defined by claim 11, the detection electrode and the reference electrode are constructed from a plurality of sets of detection electrode and reference electrode, in which the plurality of the detection electrodes are electrically connected to each other, the plurality of the reference electrodes are electrically connected to each other, and the plurality of detection electrodes and the plurality of the reference electrodes are connected to the detection circuit. This fence sensor can realize a wide range of detectable region at a low cost by detecting the changes in the electrostatic capacitances between the plurality of detection electrode and reference electrode sets using a single detection circuit.

A fence sensor defined by claim 12 comprises:

a detection electrode;

a reference electrode insulated from the detection electrode;

a detection circuit for detecting a change in electrostatic capacitance between the detection electrode and the reference electrode that is generated by the presence of an object to be detected within the detection region; and a capacitor connected in series between the detection circuit and the detection electrode, the capacitor being disposed separated from the detection electrode.

The fence sensor defined by claim 13 further comprises electrostatic spark preventing means which is disposed between the detection circuit and the detection electrode.

A fence sensor defined by claim 14 comprises:

a detection electrode;

a reference electrode insulated from the detection electrode;

a detection circuit for detecting a change in electrostatic capacitance between the detection electrode and the reference electrode that is generated by the presence of an object to be detected within the detection region; and water film separation means for separating a water film on the surface of the detection electrode from a water film grounded to the earth.

In the fence sensor defined by claim 15, the water film separation means has a trench with a width of 6 mm or more, in which the trench is opened downward.

In the fence sensor defined by claim 16, the water film separation means has a main trench with a width of 6 mm or more and an auxiliary trench with a width of less than 6 mm, in which the main trench is opened downward, and the auxiliary trench is opened downward and provided in the main trench.

A fence sensor defined by claim 17 comprises:

a detection electrode;

a reference electrode insulated from the detection electrode; and a chargeable member insulated from both of the detection electrode and the reference electrode, the chargeable member being formed from a conductor or an insulator, and the chargeable member being arranged such that at least a part of the chargeable member is situated within a detection region of the detection electrode.

A sensor for an ascending and descending member defined by claim 18 comprises:

a detection electrode;

a reference electrode insulated from the detection electrode;

an ascending and descending member insulated from both of the detection electrode and the reference electrode, the ascending and descending member being formed from a conductor or an insulator, and the ascending and descending member being arranged such that at least a part of the ascending and descending member is situated within a detection region of the detection electrode; and a detection circuit for detecting a change in electrostatic capacitance between the detection electrode and the reference electrode that is generated by the presence of an object to be detected within the detection region.

The sensor for an ascending and descending member according to the present invention belongs the same technical field and has the same problems to be solved as those of the fence sensor described above. Therefore, this fence sensor is also capable of detecting an intruder or the like who steps on the ascending and descending member that is a chargeable member. In this sensor, a change in the electrostatic capacitance between the detection electrode and the reference electrode, generated by the presence of an object to be detected within a detection region, is detected by the detection circuit.

Examples of the ascending and descending member include a ladder and an emergency stairway, and this ascending and descending member mainly designates a member on which a human being steps when ascending and descending. For example, in the case of a ladder, a rung of the ladder is made of a stainless steel pipe, and two electric wires forming a detection electrode and a reference electrode are strung inside the rung. In the case of an emergency stairway, a step is made of concrete, and an electrode member having two conductive layers forming a detection electrode and a reference electrode is attached to the rear surface of the step.

A sensor for an ascending and descending member defined by claim 19 comprises:

a detection electrode;

a reference electrode insulated from the detection electrode; and a chargeable member insulated from both of the detection electrode and the reference electrode, the chargeable member being formed from a conductor or an insulator, and the chargeable member being arranged such that at least a part of the chargeable member is situated within a detection region of the detection electrode.

PREFERRED EMBODIMENTS OF THE INVENTION

Figure 1:
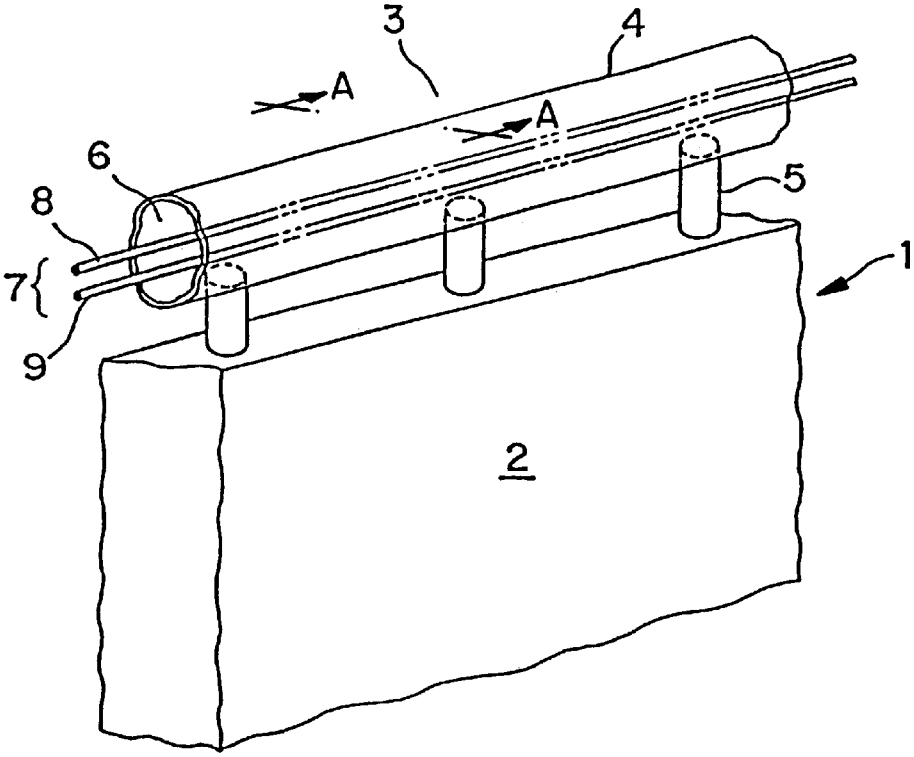
FIG. 1 is a partial perspective view which shows a first embodiment of the fence sensor according to the present invention, in which a hold member 10 is left out to show clearly a detection electrode 8 and a reference electrode 9.
Figure 2:
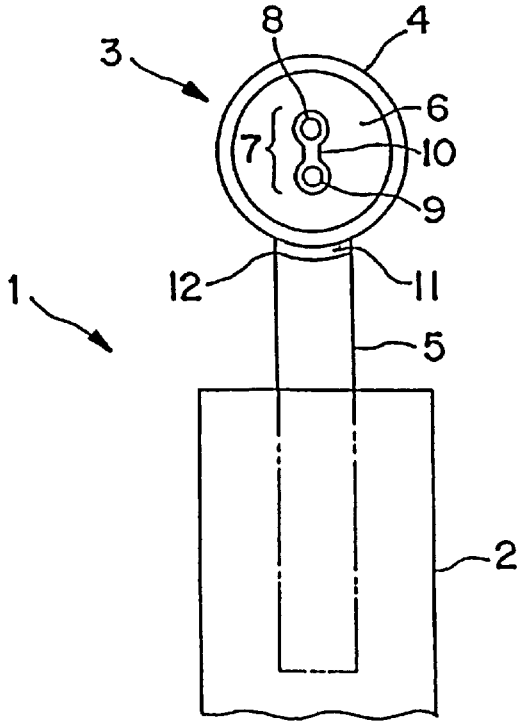
FIG. 2 is a sectional view along line A—A in FIG. 1.
Figure 3:
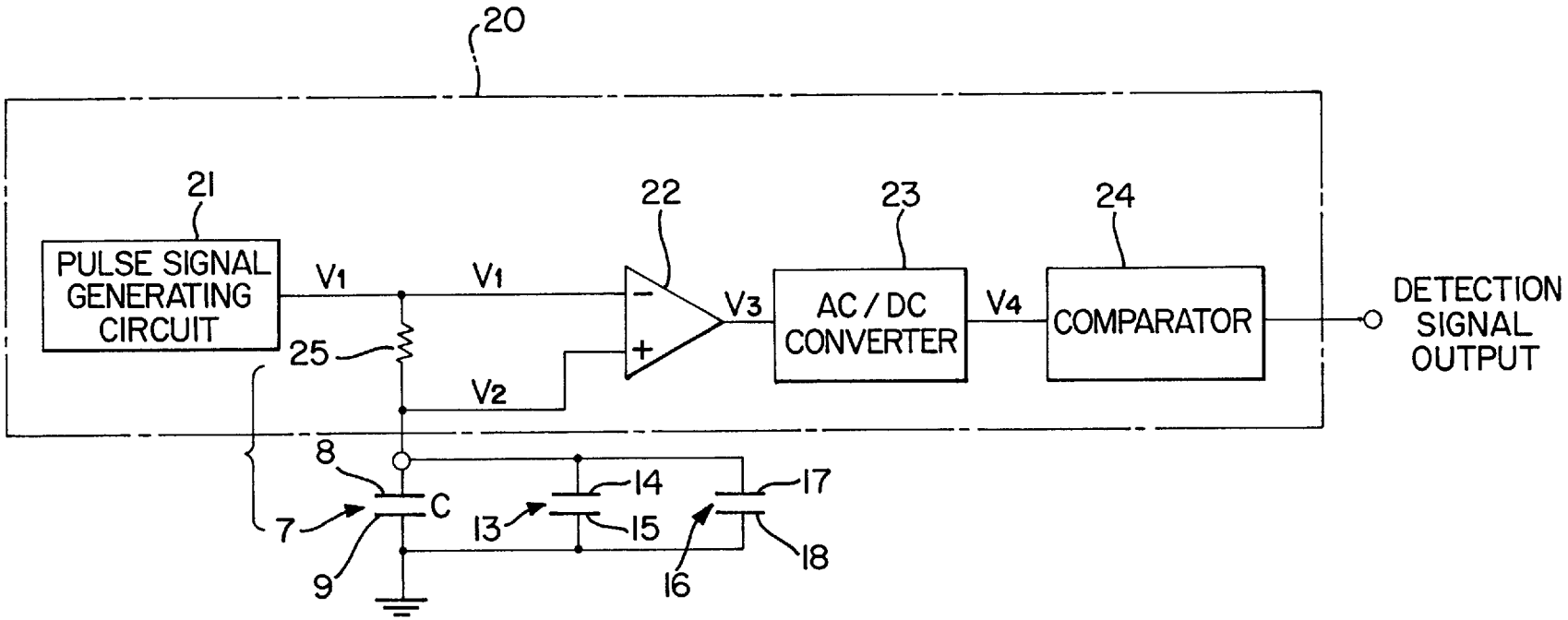
FIG. 3 is a circuit diagram which shows a detection circuit 20 of the fence sensor in FIG. 1.

A fence sensor according to a first embodiment of the present invention will be described with reference to FIGS. 1–3. The fence sensor of this embodiment is used as a sensor for a crime prevention system installed in a fence built on a terrace of an apartment house. This fence sensor is designed to give an alarm when an intruder approaches the handrail.

Reference numeral 1 represents a fence, which has a fence main body 2 and a handrail 3 provided on the upper surface of the fence main body 2. The handrail 3 includes a stainless steel hollow pipe 4, a stainless steel support pillar 5, and an insulating member 11 made of a synthetic resin for insulating the pipe 4 from the support pillar 5. An electrode member 7 is extended in the length direction of the pipe 4 in the internal space 6 of the pipe 4 that serves as a chargeable member.

The electrode member 7 consists of a detection electrode wire 8, a reference electrode wire 9 extending in parallel to the detection electrode wire 8, and a hold member 10 which holds the distance between these electrode wires. Inside the space 6, a fixing member (not shown in the drawings) for fixing the electrode member 7 at a predetermined position is provided.

Next, the overall structure of the fence sensor of this embodiment will be described. The detection electrode wire 8 is connected to a detection circuit 20 shown in FIG. 3, and the reference electrode wire 9 is grounded to the body of the apartment house. In addition, electrode members 13 and 16 provided in fences of other terraces of the same living section of the apartment house are also connected to the detection circuit 20. Namely, three detection electrode wires 8, 14, and 17 are connected in parallel, and three reference electrode wires 9, 15, and 18 are connected in parallel. These electrode wires share one detection circuit 20.

The detection circuit 20 is connected to a control circuit (not shown in the drawings). Upon receipt of a detection signal from the detection circuit 20, the control circuit causes an indoor loudspeaker (not shown in the drawings) connected to the control circuit to generate an alarm sound as well as causes a lighting system (not shown in the drawings) in the terrace to flicker.

Next, the detection circuit 20 will be described in more detail with reference to FIG. 3. The detection circuit 20 includes a pulse signal generating circuit 21, a differential amplifier 22, an AC/DC converter 23• and a comparator 24 that are connected in series. A pulse signal V1 output from the pulse signal generating circuit 21 is branched, and the wave form of the branched pulse signal is dulled due to a resistor 25 and an increase in the electrostatic capacitance of the electrode member 7.

The differential amplifier 22 amplifies the voltage difference between the pulse signal V1 and a pulse signal V2 formed by the change in the electrostatic capacitance, and the output V3 from the differential amplifier 22 is converted to a DC voltage by the converter 23. The comparator 24 compares the output V4 from the converter 23 with a predetermined detection threshold, and sends out a detection signal to the control circuit in the case where V4 is larger than the threshold.

Here, in order to position the inner wall surface of the pipe 4 within the detection region of the detection electrode wire 8, either the threshold or the distance from the detection electrode wire 8 to the inner wall surface of the pipe 4 is adjusted.

Next, operations of the fence sensor of this embodiment will be described. As an intruder approaches the pipe 4, electrostatic induction is induced in the pipe 4 by the charges on the body of the intruder. The charges on the pipe 4 increased by the electrostatic induction form an electric field on the inner wall surface of the pipe 4.

Since the pipe 4 and the support pillars 5 are insulated from each other by the insulating member 11, the increased charges on the pipe 4 will not move to the body of the apartment house via the support pillars 5. In the meantime, if the air is dry and the charge quantities on the body of the intruder are extremely large, electrostatic sparks will be generated between the pipe 4 and the body of the intruder.

However, the high voltage current of the sparks will be discharged from the surface of the pipe 4 to the upper edge 12 of the support pillar 5, and flow to the body of the apartment house. Accordingly, the high voltage current will not flow directly to the detection electrode wire 8 and the reference electrode wire 9 which are totally concealed by the pipe 4 that acts as a chargeable member. Because of this, the detection circuit 20 will not be destroyed by the generation of electrostatic sparks.

An electrostatic induction will be generated in the detection electrode wire 8 by the above-mentioned formation of the electric field, and the electrostatic capacitance between the detection electrode wire 8 and the reference electrode wire 9 will be increased by the electrostatic induction. The increase in the electrostatic capacitance is detected by the detection circuit 20. By the transmission of a detection signal from the detection circuit 20, the control circuit generates a warning sound from a loudspeaker and flickers the lighting system in the terrace to inform the residents of the approach of an intruder.

Figure 4:
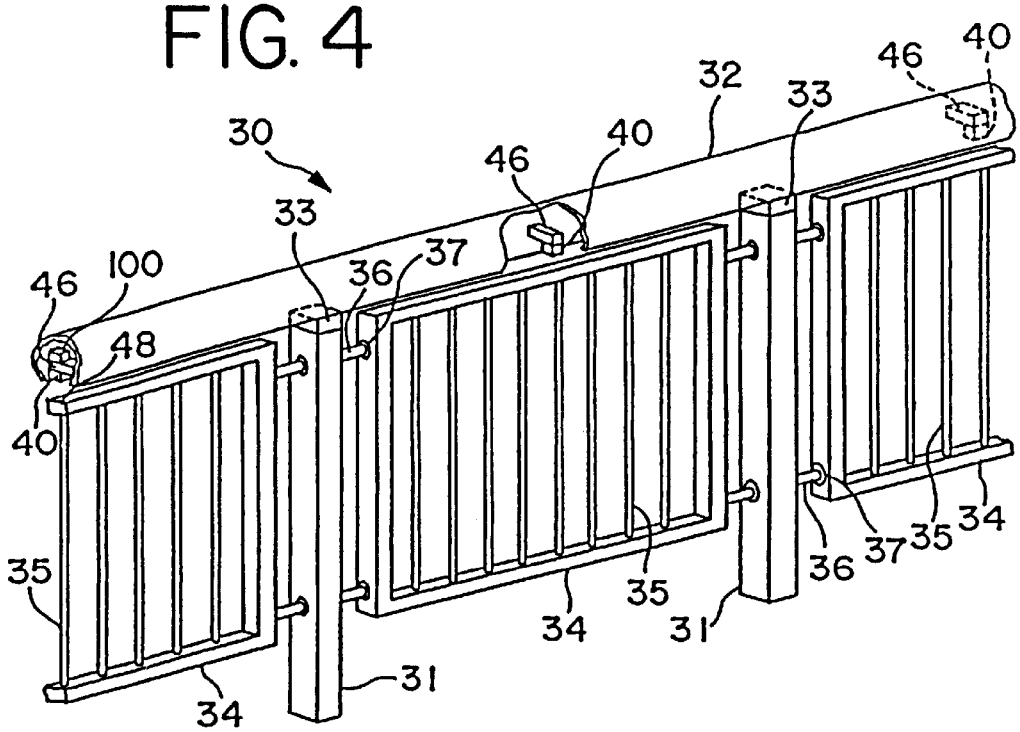
FIG. 4 is a partial perspective view which shows a second embodiment of the fence sensor according to the present invention.
Figure 5:
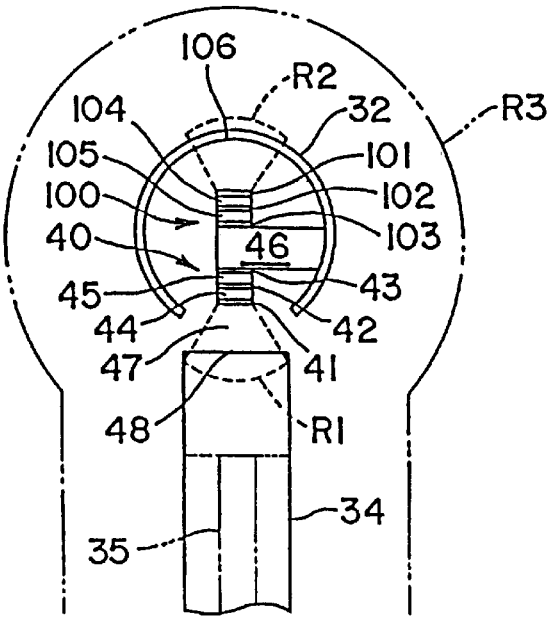
FIG. 5 is an enlarged view which shows the cross-section of the end part of the fence in FIG. 4.

Next, a second embodiment of the fence sensor according to the present invention will be described with reference to FIGS. 4 and 5. In the following description, it will be assumed that the detection circuit of this embodiment utilizes the detection circuit 20 as described in the first embodiment. Further, it will also be assumed that the control circuit sounds an alarm announcement from a loudspeaker and flickers a lighting system in the garden upon receipt of a detection signal from the detection circuit 20.

In a plurality of electrode members 40 and one electrode member 100 (that will be described later), detection electrode layers 41 and 101 of are connected in parallel, and reference electrode layers 43 and 103 are connected in parallel. These electrode layers share one detection circuit 20. Further, the reference electrode layers 43 and 103 are grounded through grounding resistors.

Reference numeral 30 shows a fence provided along the border line of lot. The fence 30 includes a plurality of electrode members 40, one electrode member 100, aluminum support pillars 31 erected with a prescribed spacing, an aluminum pipe 32 supported at the upper end of the support pillars 31 via a synthetic resin insulating member 33, frames 34 supported on the side faces of the support pillars 31 via an aluminum support member 36, and aluminum palisades 35 fixed to the frames 34.

Insulating members 37 are disposed at both ends of the support member 36 to insulate the support pillars 31 from the frames 34. The pipe 32 is installed separated from the frames 34, and its lower surface is cut out in the length direction to form an open part 47. In other words, the sectional form of the pipe 32 has a horseshoe shape.

Each electrode member 40 is formed into a roughly rectangular parallelepiped shape. Further, each electrode member 40 is formed by laminating the detection electrode layer 41, an inter-electrode charge layer 42, the reference electrode layer 43, and insulating members 44 and 45. In this structure, the insulating members 44 and 45 are respectively interposed between the detection electrode layer 41, an inter-electrode charge layer 42, and the reference electrode layer 43. Furthermore, each electrode member 40 is fixed to the lower surface of a prism-shaped insulating member 46 that is fixed to the inner wall side face of the pipe 32 at its one end and that insulates the reference electrode layer 43 from the pipe 32. Besides, each electrode member 40 is disposed such that the detection electrode layer 41 faces an upper surface 48 of the corresponding frame 34 a predetermined distance apart.

The electrode member 100 is formed into a roughly rectangular parallelepiped shape, and is formed by laminating the detection electrode layer 101, an inter-electrode charge layer 102, and the reference electrode layer 103 by interposing insulating members 104 and 105. Further, the electrode member 100 is fixed to the upper surface of the prism-shaped insulating member 46 that is fixed to the inner wall surface of the pipe 32 at its one end, and that insulates the reference electrode layer 103 and the pipe 32. Besides, the electrode member 100 has the detection electrode layer 101 arranged with a prescribed distance apart from an inner wall upper surface 106 of the pipe 32.

The inter-electrode charge layer 42 is insulated from each of the detection electrode layer 41 and the reference electrode layer 43, and is not electrically connected to any other member. The charge layer 42 supplies charge to or absorbs charge from the detection electrode layer 41 depending upon the charge quantity on the detection electrode layer 41. Namely, the charge layer 42 functions as a supply and absorb part of charge for the detection electrode layer 41.

Specifically, since two capacitors connected in series are formed by the detection electrode layer 41, the charge layer 42 and the reference electrode layer 43, the electrostatic capacitance of the area is decreased. Because of this, the changes in the electrostatic capacitance between the detection electrode layer 41 and the reference electrode layer 43 caused by the changes in the environment (e.g., changes in the temperature, humidity, radio waves, vibrations or the like), namely, noises can be reduced.

The provision of the charge layer 42 enables the ratio of the signal to noise generated by the environment (i.e., S/N ratio) to be increased, thus making it possible to maintain a stabilized detection sensitivity of the electrode member 40. As a result, the detection threshold of the detection circuit 20 can be set low, and a detection region R1 of the detection electrode layer can be extended.

Similarly, the inter-electrode charge layer 102 is insulated from each of the detection electrode layer 101 and the reference electrode layer 103, and is not electrically connected to any other members, so that it functions as a supply and absorb part of charges for the detection electrode layer 101.

In this embodiment, each of the frame 34, the palisade 35 and the pipe 32 constitutes a chargeable member. In other words, as shown in FIG. 5, the upper surface 48 of the corresponding frame 34 is situated within the detection region R1 of the detection electrode layer 41 of each electrode member 40. The detection region R1 is formed inside the open part 47.

Further, the upper surface of the inner wall of the pipe 32 is situated within a detection region R2 of the detection electrode layer 101 of the electrode member 100. In this connection, it is to be noted that the detection regions R1 and R2 shown in FIG. 5 respectively indicate the detection regions of the detection electrode layers 41 and 101 when chargeable members such as the frame 34 and the pipe 32 do not exist. Further, it is also to be noted that the range over which the body of an intruder can induce a prescribed amount of charge on the chargeable member such as the frame 34 and the pipe 32 is represented by a detection region R3.

Next, operations of the fence sensor of this embodiment will be described. When an intruder approaches the pipe 32 to jump over the fence 30, electrostatic induction is induced by the charges on the body of the intruder. The increased charges on the pipe 32 due to the electrostatic induction form an electric field in the upper surface of the inner wall of the pipe 32.

Since the pipe 32 is insulated from the support pillar 31, the charges increased by the electrification do not migrate to the ground via the support pillar 31. In the meantime, since the detection electrode layer 101 and the reference electrode layer 103 are concealed by the pipe 32 which acts as a chargeable member, a high voltage current generated by the electrostatic sparks will not flow directly to the detection circuit 20.

Since the above-mentioned electric field is formed within the detection region R2 of the detection electrode layer 101, an electrostatic induction will be induced in the detection electrode layer 101 by the approach of an intruder. The electrostatic capacitance between the detection electrode layer 101 and the reference electrode layer 103 is increased by the electrostatic induction, and the increase in the electrostatic capacitance is detected by the detection circuit 20. When the detection circuit 20 sends out a detection signal, the control circuit causes the loudspeaker to issue a warning announcement and causes the lighting system in the garden to flicker to inform the residents of the approach of the intruder.

Next, if an intruder approaches the pipe 30 by crawling from sideway of the fence 30, electrostatic induction is generated in the palisade 35. The increased charges on the palisade 35 due to the electrostatic induction migrate to the frame 34, and form an electric field on the upper surface 48 of the frame 34.

Since the frame 34 is insulated from the support pillar 31, the charges increased by the electrification do not migrate to the ground via the support pillar 31. In the meantime, since the detection electrode layer 41 and the reference electrode layer 43 are concealed by the pipe 32, a high voltage current generated by the electrostatic sparks will not flow directly to the detection circuit 20.

Since the electric field is formed within the detection region R1 of the detection electrode layer 41, electrostatic induction is generated in the detection electrode layer 41. The electrostatic capacitance between the detection electrode layer 41 and the reference electrode layer 43 is increased by the electrostatic induction, and the increase is detected by the detection circuit 20. When the detection circuit 20 sends out a detection signal, the control circuit causes the loudspeaker to issue an alarm warning by voice and causes the lighting system in the garden to flicker to inform the residents of the approach of an intruder.

According to this embodiment, it is possible to make the entirety of the fence as a detection region by simply installing electrode members at appropriate places of the fence. Because of this, it eliminates the need for laying around electric wires on the inside of the fence, as was required in the conventional sensor of electric field formation type. Further, it is possible to minimize the restrictions when designing the fence.

Figure 6:
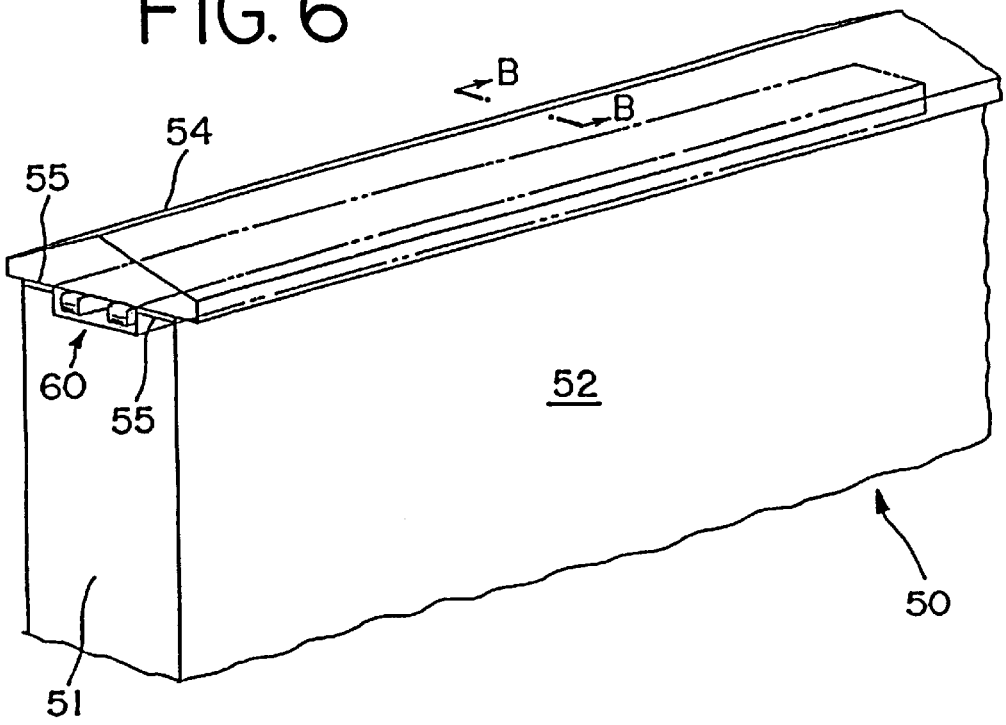
FIG. 6 is a partial perspective view which shows a third embodiment of the fence sensor according to the present invention.
Figure 7:
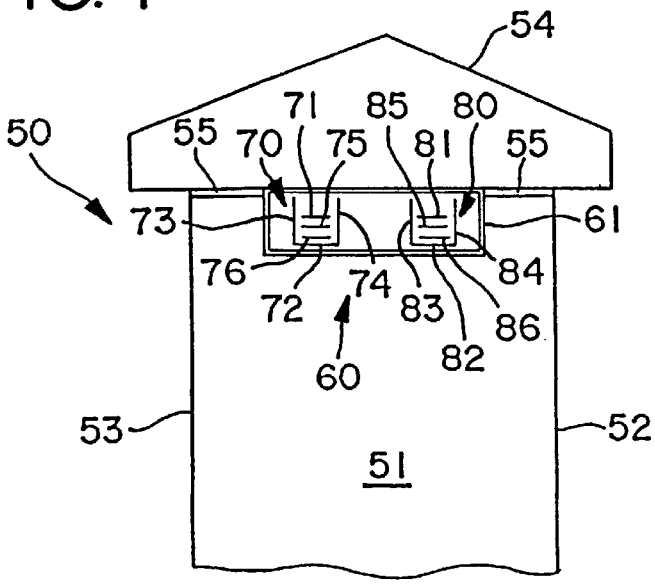
FIG. 7 is a sectional view along line B—B in FIG. 6.
Figure 8:
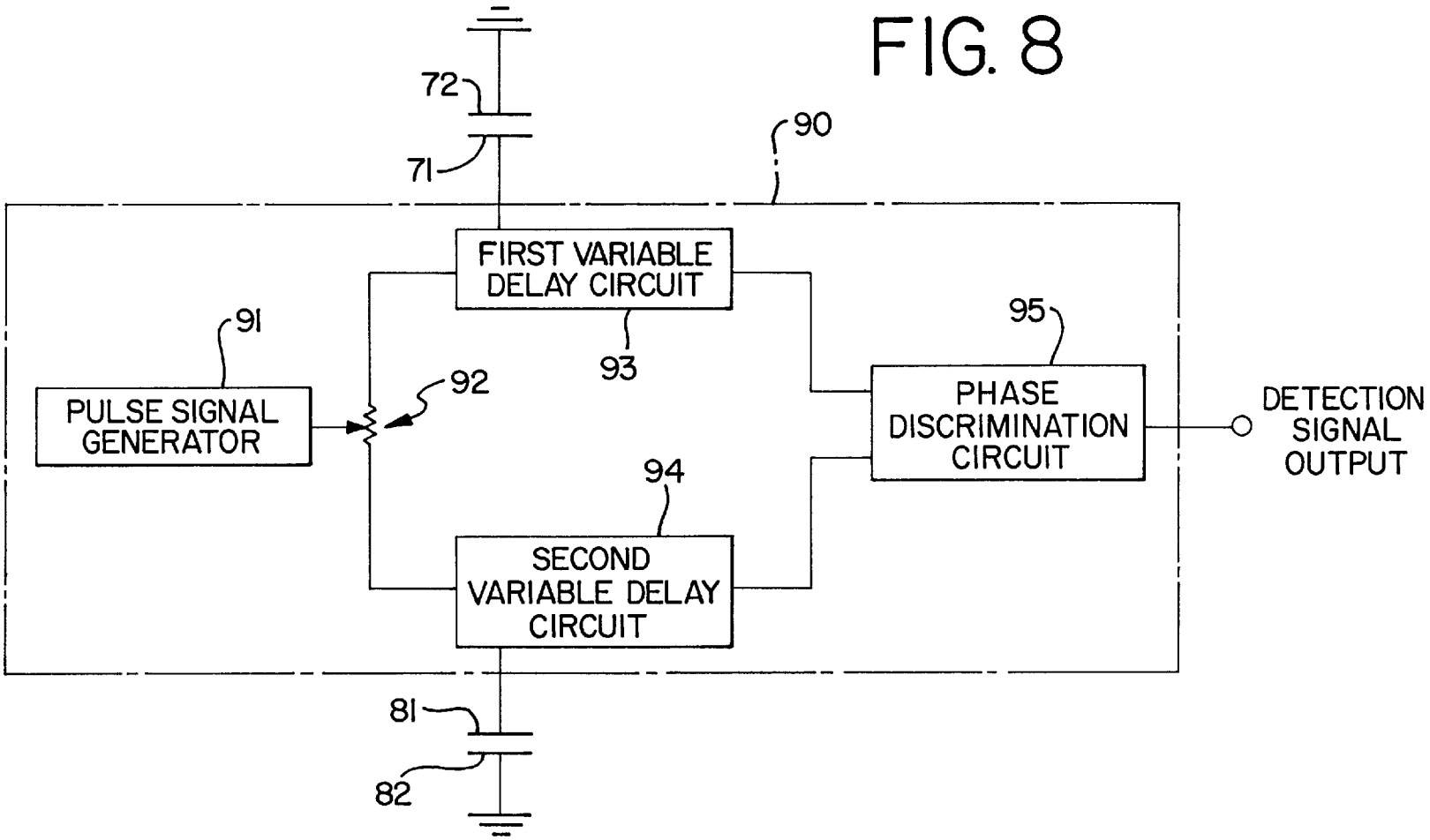
FIG. 8 is a circuit diagram which shows a detection circuit 90 of the fence sensor in FIG. 6.

Next, a third embodiment of the fence sensor according to the present invention will be described with reference to FIGS. 6–8. Reference numeral 50 indicates a concrete fence installed along the border line of lot. This concrete fence 50 includes an electrode member 60, a wall body 51 having sidewalls 52 and 53, and a concrete chargeable member 54 fixed to the upper part of the wall body 51 via an insulating member 55 which is a filling material made of a synthetic resin.

The electrode member 60 is housed in a trench provided in the upper part of the wall body 51 so as to be disposed in the length direction of the wall body 51 and the chargeable member 54. This electrode member 60 is arranged between the wall body 51 and the chargeable member 54. Further, the electrode member 60 includes a case 61 made of a synthetic resin, and a first electrode member 70 and a second electrode member 80 housed in the case 61.

The first electrode member 70 includes a first detection electrode plate 71, a first reference electrode plate 72, first shield electrode plates 73 and 74 which are respectively erected from side edges of the first reference electrode plate 72, and first inter-electrode charging plates 75 and 76.

The second electrode member 80 includes a second detection electrode plate 81, a second reference electrode plate 82, second shield electrode plates 83 and 84 which are respectively erected from side edges of the second reference electrode plate 82, and second inter-electrode charging plates 85 and 86.

In the first electrode member 70, the first detection electrode plate 71 and the first inter-electrode charging plates 75 and 76 are insulated from each other by an insulating member (not shown) filled in the case 61. Further, these plates 71, 75 and 76 are also insulated from the first reference electrode plate 72 and the first shield electrode plates 73 and 74 (which are formed integrally with the first reference electrode plate 72 so as to achieve electrical connection) by the insulating member. Similarly, in the second electrode member 80, the second detection electrode plate 81 and the second inter-electrode charging plates 85 and 86 are insulated from each other by the insulating member in the case 61. Further, these plates 81, 85 and 86 are also insulated from the second reference electrode plate 82 and the second shield electrode plates 83 and 84 (which are formed integrally with the second reference electrode plate 82 so as to achieve electrical connection) by the insulating member.

Each of the first shield electrode plates 73 and 74 acts as directivity control means for controlling (limiting) the directions of the electric lines of force of the first detection electrode plate 71. Similarly, each of the second shield electrode plates 83 and 84 acts as directivity control means for controlling (limiting) the directions of the electric lines of force of the second detection electrode plate 81. According to the arrangements described above, the electric lines of force that extend sideways of the detection electrode plates 71 and 81 are broken by each shield electrode plate, thus making it possible to limit only to the electric lines of force that extend in the upward direction of the detection electrode plates 71 and 81. Consequently, it is possible to restrict the detection region of the detection electrode plates 71 and 81 in the direction of the chargeable member 54.

Accordingly, by providing the first and second shield electrode plates 73 and 84, it is possible to prevent an erroneous detection of a pedestrian passing by the fence. In addition, by providing the first and second shield plates 74 and 83, it is possible to exclude mutual influence between the first detection electrode plate 71 and the second detection electrode plate 81.

On the surface of the chargeable member 54, a water repellent layer (not shown in the drawings) formed of a water repellent material that includes a synthetic resin as a main component is provided to prevent infiltration of moisture into the chargeable member 54. Further, the top surface of the chargeable member 54 is formed into a roof shape in order to prevent collection of rain water in the upper part of the chargeable member 54.

Next, the overall structure of the fence sensor of this embodiment will be described. The first detection electrode plate 71 and the second detection electrode plate 81 are connected to a detection circuit 90 shown in FIG. 8, and the first reference electrode plate 72 and the second reference electrode plate 82 are grounded. The detection circuit 90 is connected to a control circuit (not shown in the drawings). For the control circuit in this embodiment, the control circuit of the second embodiment is utilized.

First, the detection circuit 90 will be described with reference to FIG. 8. The detection circuit 90 includes a pulse signal generator 91, a variable resistor 92, a first variable delay circuit 93, a second variable delay circuit 94, and a phase discrimination circuit 95.

A pulse signal output from the circuit 91 is branched via the variable resistor 92 to the first variable delay circuit 93 and the second variable delay circuit 94. The first detection electrode plate 71 is connected to the first variable delay circuit 93, and the second detection electrode plate 81 is connected to the second variable delay circuit 94. The first variable delay circuit 93 delays the input pulse signal in response to the electrostatic capacitance between the first detection electrode plate 71 connected thereto and the first reference electrode plate 72, and then sends the result to the phase discrimination circuit 95 which serves as a comparison means. Similarly, the second variable delay circuit 94 delays the input pulse signal in response to the electrostatic capacitance between the second detection electrode plate 81 connected thereto and the second reference electrode plate 82, and then sends the result to the phase discrimination circuit 95.

The phase discrimination circuit 95 compares the phases of the pulse signals sent from the first and second variable delay circuit 93 and 94, and sends out a detection signal to the control circuit when it detects a phase shift which exceeds a predetermined threshold.

Next, operations of the fence sensor in this embodiment will be described. When an intruder tries to put his hands on the upper part of the chargeable member 54 from the side of the sidewall 53 situated on the outside of the lot, the chargeable member 54 is electrified, and a dielectric polarization is generated. The charges generated by the dielectric polarization are distributed more heavily in the portion situated on the outside of the lot of the chargeable member 54.

The charge distribution of the chargeable member 54 affects also the charge distribution on the rear surface of the chargeable member 54, with a result that the quantity of polarized charge in the vicinity of the first detection electrode plate 71 is larger than the quantity of polarized charge in the vicinity of the second detection electrode plate 81. Because of this, the strength of the electric field formed on the rear surface of the chargeable member 54 varies locally depending upon the charge quantity. As a result of the electrostatic induction generated by the electric field whose strength varies locally, the charge quantity on the first detection electrode plate 71 becomes larger than the charge quantity on the second detection electrode plate 81.

Accordingly, the electrostatic capacitance between the first detection electrode plate 71 and the first reference electrode plate 72 becomes larger than the electrostatic capacitance between the second detection electrode plate 81 and the second reference electrode plate 82. As a result, the phase discrimination circuit 95 discriminates that the pulse signal from the first variable delay circuit 91 is delayed with respect to the pulse signal from the second variable delay circuit 94, and then sends out a detection signal to the control circuit.

On the contrary, if a resident tries to put on his hands on the chargeable member 54 from the side of the sidewall 52 situated on the inside of the lot, the electrostatic capacitance between the second detection electrode plate 81 and the second reference electrode plate 82 becomes larger than the electrostatic capacitance between the first detection electrode plate 71 and the first reference electrode plate 72. As a result, the phase discrimination circuit 95 discriminates that the pulse signal from the second variable delay circuit 94 is delayed with respect to the pulse signal from the first variable delay circuit 93. In such a case, the phase discrimination circuit 95 will not send out a detection signal to the control circuit. By providing the first and second detection electrode plates 71 and 81 in the way described above, it is possible for the fence sensor of the embodiment to detect only an intruder from the outside of the lot.

Figure 9:
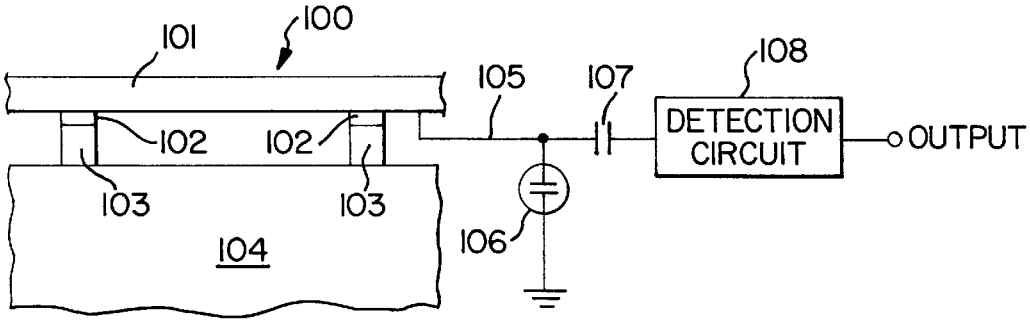
FIG. 9 is a block diagram which shows a fourth embodiment of the fence sensor according to the present invention.

Next, a fourth embodiment of the fence sensor according to the present invention will be described with reference to FIG. 9. The fence sensor in this embodiment is used in a crime prevention system that uses a handrail 101 in the terrace of an apartment house as a detection electrode.

A fence includes a handrail 101 and support pillars 103 for supporting the handrail 101. The support pillars 103 are provided on a concrete body 104 via an insulating member 102 made of a synthetic resin. The handrail 101 is connected to a detection circuit 108 via a lead wire 105. In this regard, it is preferable that a shielded wire is used for the lead wire in order for this part to be immune to the effect of variations in the external electric field.

A neon tube 106 is connected between the lead wire 105 and the ground, and a capacitor 107 is connected in series. The neon tube 106 serves as an electrostatic spark preventing means for preventing an excessive current caused by the occurrence of electrostatic sparks from flowing into the capacitor 107.

In this embodiment, the threshold of the detection circuit 108 is set such that a detection signal is output when the electrostatic capacitance between the detection electrodes in the static state exceeds 100 pF. For an electrostatic capacitance of 10,000 pF of the handrail, if the electrostatic capacitance of the capacitor is set at 100 pF, the electrostatic capacitance as seen from the detection circuit 108 in an approximately static state can be reduced to slightly below 100 pF.

According to the fence sensor in this embodiment, the capacitor 107 is disposed at a spot removed from the handrail 101 where changes in the temperature and humidity are moderate, and the capacitor 107 is connected to handrail 101 via the lead wire 105. By arranging the capacitor 107 in such a way, it is possible to minimize the temperature rise of the capacitor 107, even in the case where the handrail 101 is installed in a place where it is exposed to the direct sunlight and where the temperature and humidity are liable to change sharply. Namely, it is possible to prevent variations in the electrostatic capacitance of the capacitor 107 that are caused by the effect of the temperature or the like on the dielectric and other parts inside the capacitor 107, thus making it possible to prevent malfunctions of the detection circuit 108.

Now, in this embodiment, the electrostatic capacitance of the handrail 101 in the static state varies depending upon various conditions such as the length of the handrail 101, the thickness of the insulator 102, and the like. However, the fence sensor of this invention is designed so as to be able to adjust the electrostatic capacitance of the capacitor 107, and therefore it is possible to adjust the electrostatic capacitance of the capacitor 107 to a proper value where the detection circuit 108 can properly operate. This means there is no need for adjusting the threshold of the detection circuit 108. For the reasons described above, according to the present invention, it is possible to easily construct the fence sensor. Further, it is also possible to quickly install the fence sensor on the construction.

Figure 10:
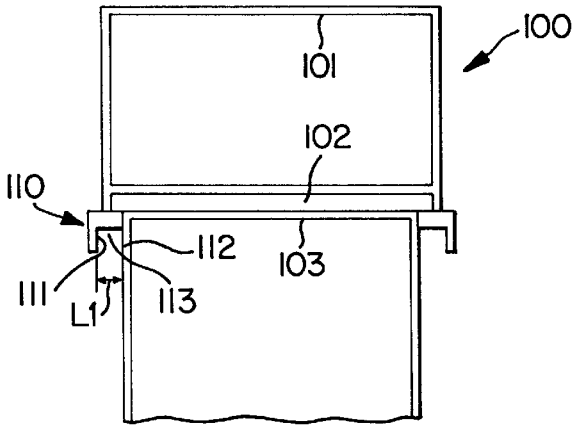
FIG. 10 is a partial perspective view which shows a fifth embodiment of the fence sensor according to the present invention.

Next, a fifth embodiment of the fence sensor according to the present invention will be described with reference to FIG. 10. In this connection, the embodiment given below relates to the insulating member 102 of the fourth embodiment of the fence sensor.

In the periphery of the insulating member 102, a draining wall 110 which acts as water film separating means is overhung downward at the upper end part of the support pillar 103. Inner wall surface 111 of the draining wall 110 is positioned with a distance L1 (more than 6 mm) apart from the side face 112 of the support pillar 103, and a trench 113 is formed between the inner wall surface 111 and the side face 112 of the support pillar 103.

When a film of rain water or the like is formed on respective surfaces of the handrail 101 and the support pillar 103 of the fence, the electrostatic capacitance of the handrail 101 increases suddenly just before the water film on the surface of the handrail 101 and the water film on the surface of the support pillar 103 come into contact. This is because the distance between both water films becomes extremely small, and a state similar to the state in which the handrail 101 is brought close to the ground is realized. In this case, the detection circuit 108 outputs a detection signal because of a sudden increase in the electrostatic capacitance of the handrail 101, and then the system commits a malfunction. However, by providing the draining wall 110 in the periphery of the insulating member 102, as in this embodiment, it is possible to prevent the contact of both water films formed on respective surfaces of the handrail 101 and the support pillar 103. This is because it is possible, by setting the distance L1 of the trench 113 to be more than 6 mm, to prevent both water films from contacting across the trench 113 under the action of the surface tension. Accordingly, the malfunction of the detection circuit 108 can be prevented.

Figure 11:
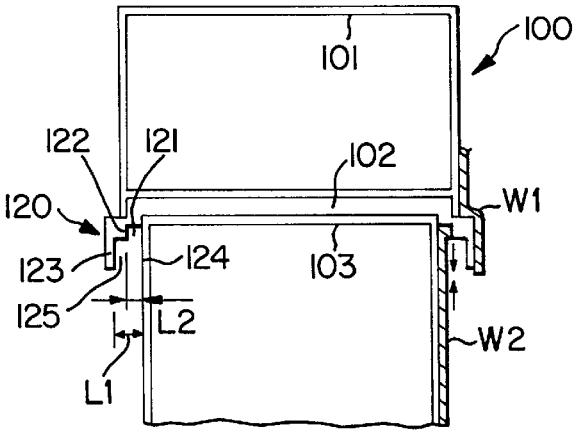
FIG. 11 is a partial perspective view which shows a sixth embodiment of the fence sensor according to the present invention.
Figure 12:
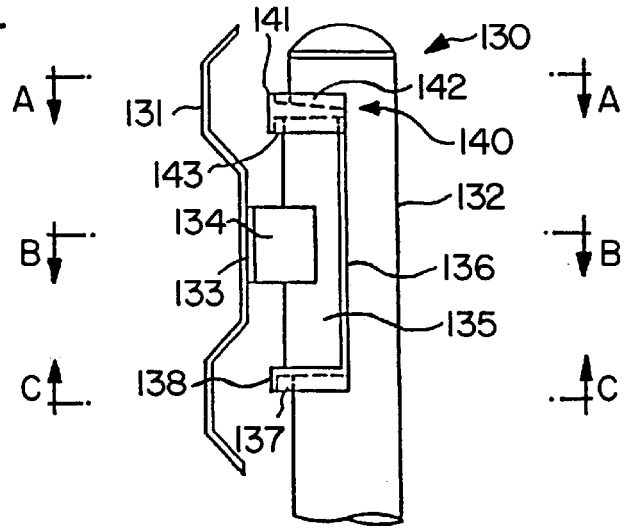
FIG. 12 is an explanatory diagram which shows a seventh embodiment of the fence sensor according to the present invention, in which the positional relationship between a support pillar and a guardrail of the fence sensor is shown.
Figure 13:
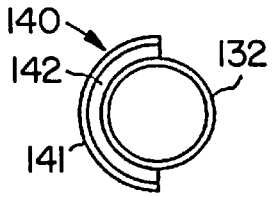
FIG. 13 is a sectional view along line A—A in FIG. 12.
Figure 14:
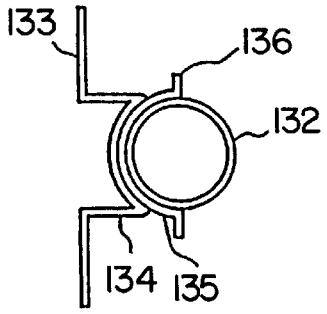
FIG. 14 is a sectional view along line B—B in FIG. 12.
Figure 15:
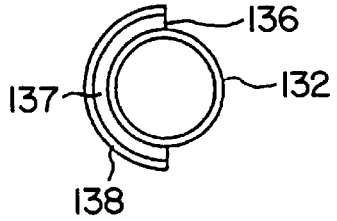
FIG. 15 is a sectional view along line C—C in FIG. 12.

Next, a sixth embodiment of the fence sensor according to the present invention will be described with reference to FIG. 11. This embodiment relates to a fence sensor having means like the water film separating means in the fifth embodiment.

In the periphery of the insulating member 102, a draining wall which serves as water film separating means is overhung downward from the upper end part of the support pillar 103. The upper inner wall surface 122 of the draining wall 120 is positioned with a distance L2 apart from the side face 124 of the support pillar 103, and an auxiliary trench 121 is formed between the upper inner wall surface 122 and the side face 124 of the support pillar 103. In this connection, the distance L2 should be equal to 1 mm, or more than 1 mm and less than 6 mm. The condition for L2 to be more than or equal to 1 mm comes from the requirement that it should be larger than the thickness of the water film, and the condition for less than 6 mm comes from the requirement that it is necessary to make it smaller than the distance L1 in the above. The lower inner wall surface 123 of the draining wall 120 is positioned with a distance L1 (more than or equal to 6 mm) apart from the side face 124 of the support pillar 103, and a main trench 125 is formed between the lower inner wall surface 123 and the side face 124 of the support pillar 103.

When wind and rain blow sideways to the support pillar 103, a water film W2 creeps upward on the surface of the support pillar 103. However, when the upper end of the water film W2 reaches the auxiliary trench 121, the water film W2 that tries to go up further is pushed back in the auxiliary trench 121 by the self-weight of the water film W2, and the further rise of the water film W2 is prevented. Because of this, the separation of water films W1 and W2 is maintained. Accordingly, according to the fence sensor in this embodiment, it is possible to prevent malfunctions of the detection circuit 108 even under wind and rain blowing sideways.

Next, a seventh embodiment of the fence sensor according to the present invention will be described with reference to FIGS. 12–15. This embodiment relates to a fence sensor which utilizes an existing guardrail, and which is used for detecting a vehicle, a pedestrian or the like that makes approach to the guardrail.

A fence sensor 130 includes a guardrail part 131 made from iron plate, and a plurality of iron support pillars 132 supporting the extending guardrail part. On the periphery of the support pillar 132, a support member 134 equipped with support plates 133 on the left and right is fixed with bolts (not shown) or the like. The bolt is connected electrically to the support member 134, while the bolt is insulated from the support pillar 132 with an insulating member (not shown) such as a spacer made of an insulator. Further, the bolt is connected to a detection circuit (not shown) via a lead wire. Since the guardrail part 131 is fixed to the support plate 133, and is connected electrically to the support plate 133 and the support member 134, the entirety of the guardrail part forms a detection electrode.

Since the lower part of the support pillar 132 is buried in the ground or the like, the support pillar 132 is grounded. Because of this, the support pillar 132 and the support member 134 are insulated with a prescribed distance apart with a rubber insulating member 135 having a semicylindrical shape. However, just before the water films on the surface of the support member 134 and the support pillar 132 make a contact, the detection circuit triggers a malfunction. For this reason, in this embodiment, four water film separation means are provided in the insulating member 135. A first water film separation means is an upper surface trench 142 of an upper part water film separation member 140. The upper surface trench 142 is formed between a draining wall 141 and the surface of the support pillar 132. Both ends of the upper surface trench 142 are left open. Further, the bottom surface of the upper surface trench is sloped from the central part toward both ends, so that water that falls from the top portion of the support pillar 132 is drained from both ends of the upper surface trench 142. This structure prevents infiltration of water into the surface of the insulating member 135. A second water film separation means is a lower surface trench 143 of the upper water film separation member 140. The width of the trench is more than 6 mm. According to the second water film separation means, it is possible to achieve the same results those achieved by the draining wall 110 that is a water film separation means in the fifth embodiment. Namely, the lower surface trench 143 maintains separation of a water film on the surface of the support pillar 132 and a water film on the surface of the insulating member 135. A third water film separation means is a side part water film separation member 136 that prevents the infiltration of water film into the surface of the insulating member 135 from the sideway of the insulating member 135. A fourth water film separation means is a lower trench 137 of a lower water film separation means 138. The width of the trench is more than 6 mm. According to the fourth water film separation means, it is possible to achieve the same results those achieved by the lower trench 143 of the water film separation trench 140. Namely, the lower trench 137 maintains the separation of a water film on the surface of the insulating member 135 and a water film on the surface of the support pillar 132.

Figure 16:
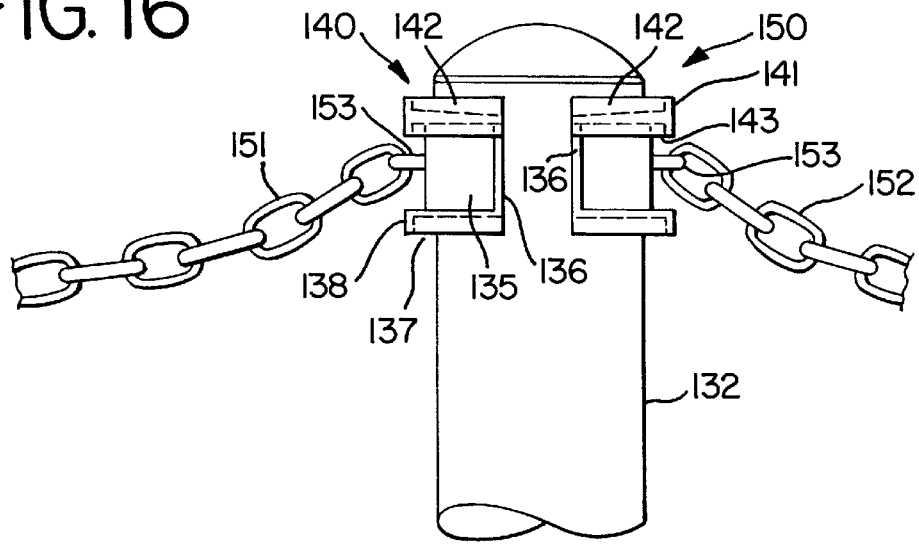
FIG. 16 is an explanatory diagram which shows an eighth embodiment of the fence sensor according to the invention, in which the positional relationship between a support pillar and a chains of the fence sensor is shown.

Next, an eighth embodiment of the fence sensor according to the present invention will be described with reference to FIG. 16. This embodiment directed to a fence sensor that utilizes conductive chains 151 and 152 which are strung between a plurality of support pillars 132 as detection electrodes, and that is used for detecting an object that makes approach to the chains.

In this connection, it is to be noted that in this embodiment the structure of water film separation means is generally the same as in the sixth embodiment, and elements having the same functions will be indicated by the same numerals.

In this embodiment, chain fixing members 153 on the periphery of the support pillar 132 are insulated from the support pillar 132 with a spacer made of an insulator (not shown), and are connected to a detection circuit (not shown) via a lead wire. Accordingly, the entirety of the chain fixing members 153 that are formed of a conductive metal and the chains 151 and 152 forms a detection electrode.

Figure 17:
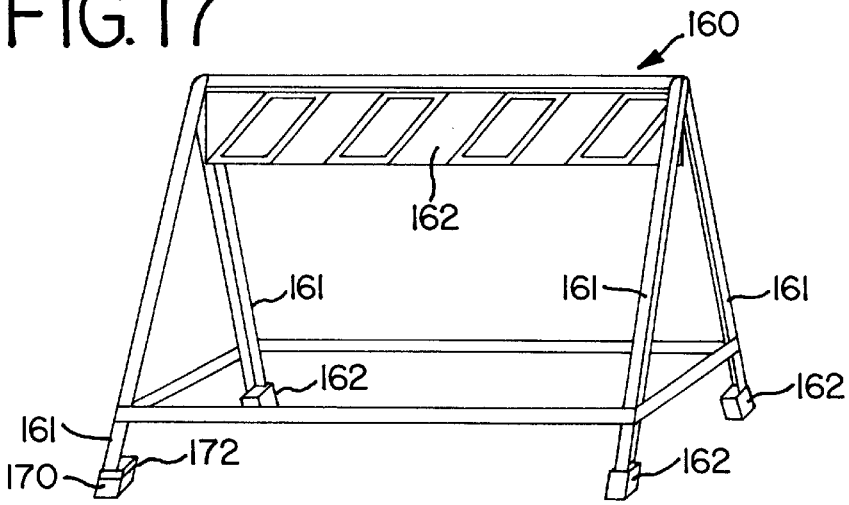
FIG. 17 is a perspective view which shows a ninth embodiment of the fence sensor according to the present invention.
Figure 18:
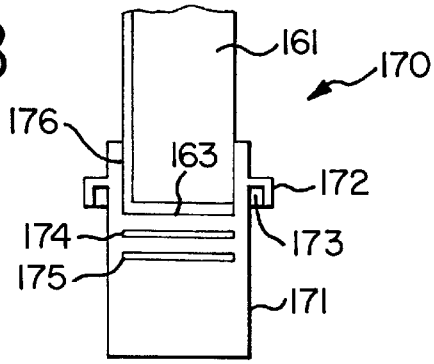
FIG. 18 is a longitudinal view which shows a detection leg part 170 in FIG. 17.

Next, the fence sensor according to a ninth embodiment of the invention will be described with reference to FIGS. 17 and 18. The fence sensor in this embodiment utilizes a movable iron fence 160 that is used on a construction site or the like as a chargeable member. This fence sensor is designed to detect human being or the like that makes approach to the fence 160 by a detection electrode installed in a detection leg part 170. In the upper part of the detection leg part 170, there are provided an engaging hole 176 that engages with the end part of a support pillar 161, and water film separation means 172 having a trench 173 formed in its periphery. The water film separation means 172 separates water films on the surface of the fence 160 acting as a chargeable member and its support pillar 161, and a water film on the surface 171 of the lower part of the detection leg part 170. Inside the detection leg part 170, there are arranged a detection electrode 174 and a ground electrode 175 that face with each other. In this embodiment, the threshold of a detection circuit (not shown) is adjusted such that an end of the support pillar 161 in the engaging hole 176 is positioned within the detection region of the detection electrode 174. In this connection, each of the leg parts of the other three support pillars 161 (other than the one on which the detection leg part 170 is mounted) is provided with a height adjustment member 162 for equalizing their height with that of the detection leg part 170.

INDUSTRIAL UTILIZATION

As described in the above, the fence sensor according to the present invention can be utilized mainly as a sensor for crime prevention for detecting an intruder or the like.

What is claimed is:

1. A fence sensor, comprising:

a detection electrode;

a reference electrode insulated from the detection electrode;

a chargeable member insulated from both of the detection electrode and the reference electrode, the chargeable member being arranged such that at least a part of the chargeable member is situated within a detection region of the detection electrode, and the chargeable member being formed from a conductor; and a detection circuit for detecting a change in the electrostatic capacitance between the detection electrode and the reference electrode that is generated by the presence of an object to be detected within the detection region.

2. The fence sensor as claimed in claim 1, further comprising water film separation means for separating a water film on the surface of the chargeable member from a water film grounded to the earth.

3. A fence sensor, comprising:

a detection electrode;

a reference electrode insulated from the detection electrode;

a chargeable member arranged such that at least a part of the chargeable member is situated within a detection region of the detection electrode, the chargeable member being formed from an insulator; and a detection circuit for detecting a change in the electrostatic capacitance between the detection electrode and the reference electrode that is generated by the presence of an object to be detected within the detection region.

4. The fence sensor as claimed in claim 1 or 3, wherein the detection electrode and the reference electrode are partially or completely concealed by the chargeable member.

5. The fence sensor as claimed in claim 1 or 3, wherein the reference electrode is connected electrically to the ground or a building.

6. The fence sensor as claimed in claim 1 or 3, wherein the chargeable member is provided with water repellent means.

7. The fence sensor as claimed in claim 1 or 3, further comprising directivity control means for limiting the direction of the electric lines of force of the detection electrode.

8. The fence sensor as claimed in claim 7, wherein the directivity control means is a shielded electrode connected to the reference electrode.

9. The fence sensor as claimed in claim 1 or 3, further comprising at least one inter-electrode chargeable member which is disposed between the detection electrode and the reference electrode, and which is insulated from both of the detection electrode and the reference electrode.

10. The fence sensor as claimed in claim 1 or 3, wherein the detection electrode includes first and second detection electrodes which are insulated from each other, and wherein the detection circuit includes comparison means for comparing electrostatic capacitance between the first detection electrode and the reference electrode with electrostatic capacitance between the second detection electrode and the reference electrode.

11. The fence sensor as claimed in claim 1 or 3, wherein the detection electrode and the reference electrode are constructed from a plurality of sets of detection electrode and reference electrode, in which the plurality of the detection electrodes are electrically connected to each other, the plurality of the reference electrodes are electrically connected to each other, and the plurality of detection electrodes and the plurality of the reference electrodes are connected to the detection circuit.

12. A fence sensor, comprising:

a detection electrode;

a reference electrode insulated from the detection electrode;

a detection circuit for detecting a change in electrostatic capacitance between the detection electrode and the reference electrode that is generated by the presence of an object to be detected within the detection region; and a capacitor connected in series between the detection circuit and the detection electrode, the capacitor being disposed separated from the detection electrode.

13. The fence sensor as claimed in claim 12, further comprising electrostatic spark preventing means which is disposed between the detection circuit and the detection electrode.

14. A fence sensor, comprising:

a detection electrode;

a reference electrode insulated from the detection electrode;

a detection circuit for detecting a change in electrostatic capacitance between the detection electrode and the reference electrode that is generated by the presence of an object to be detected within the detection region; and water film separation means for separating a water film on the surface of the detection electrode from a water film grounded to the earth.

15. The fence sensor as claimed in claim 2 or 14, wherein the water film separation means has a trench with a width of 6 mm or more, in which the trench is opened downward.

16. The fence sensor as claimed in claim 2 or 14, wherein the water film separation means has a main trench with a width of 6 mm or more, and an auxiliary trench with a width of less than 6 mm, in which the main trench is opened downward, and the auxiliary trench is opened downward and provided in the main trench.

17. A fence sensor, comprising:

a detection electrode;

a reference electrode insulated from the detection electrode; and a chargeable member insulated from both of the detection electrode and the reference electrode, the chargeable member being formed from a conductor or an insulator, and the chargeable member being arranged such that at least a part of the chargeable member is situated within a detection region of the detection electrode.

18. A sensor for an ascending and descending member, comprising:

a detection electrode;

a reference electrode insulated from the detection electrode;

an ascending and descending member insulated from both of the detection electrode and the reference electrode, the ascending and descending member being formed from a conductor or an insulator, and the ascending and descending member being arranged such that at least a part of the ascending and descending member is situated within a detection region of the detection electrode; and a detection circuit for detecting a change in electrostatic capacitance between the detection electrode and the reference electrode that is generated by the presence of an object to be detected within the detection region.

19. A sensor for an ascending and descending member, comprising:

a detection electrode;

a reference electrode insulated from the detection electrode; and a chargeable member insulated from both of the detection electrode and the reference electrode, the chargeable member being formed from a conductor or an insulator, and the chargeable member being arranged such that at least a part of the chargeable member is situated within a detection region of the detection electrode.

* * * * *